United States Patent [19]

Clapham

[11] Patent Number: 4,657,308

[45] Date of Patent: Apr. 14, 1987

[54] MINERAL CUTTER PICK

[75] Inventor: William S. Clapham, Hoyland, England

[73] Assignee: Hall & Pickles Limited, Sheffield, England

[21] Appl. No.: 823,319

[22] Filed: Jan. 28, 1986

[30] Foreign Application Priority Data

Feb. 22, 1985 [GB] United Kingdom ..... 8504668

[51] Int. Cl.[4] ..... E21C 35/22; E21F 5/02

[52] U.S. Cl. ..... 299/81; 299/17

[58] Field of Search ..... 299/81, 17, 91, 12

[56] References Cited

U.S. PATENT DOCUMENTS

| | | | |
|---|---|---|---|
| 4,569,558 | 2/1986 | Hood | 299/81 |
| 4,573,744 | 3/1986 | Clemmow et al. | 299/81 |

FOREIGN PATENT DOCUMENTS

| | | | |
|---|---|---|---|
| 875332 | 3/1953 | Fed. Rep. of Germany | 299/91 |
| 2134893 | 2/1972 | Fed. Rep. of Germany . | |
| 3202315 | 7/1983 | Fed. Rep. of Germany | 299/17 |
| 3334031 | 4/1985 | Fed. Rep. of Germany | 299/17 |
| 9996962 | 6/1965 | United Kingdom . | |
| 1309005 | 3/1973 | United Kingdom . | |
| 1573505 | 8/1980 | United Kingdom . | |
| 2043746 | 10/1980 | United Kingdom | 299/91 |
| 2104945 | 3/1983 | United Kingdom . | |

OTHER PUBLICATIONS

Acco Babcock Inc. "Thru-Flush", 10/1982.

*Primary Examiner*—Stephen J. Novosad
*Assistant Examiner*—Michael A. Goodwin
*Attorney, Agent, or Firm*—Trexler, Bushnell & Wolters, Ltd.

[57] ABSTRACT

A mineral cutter pick 1 comprises a head 2 terminating at one end thereof in a hard material tip 3, an integral shank 4 extending from the head 2 in a direction away from the tip 3, at least one laterally extending shoulder 5 provided on the head 2, and a bore 6 extending through the shoulder 5, generally in the longitudinal direction 8 of the pick 1, through which bore 6 a water spray or jet may be passed.

9 Claims, 6 Drawing Figures

MINERAL CUTTER PICK

Figure 1:
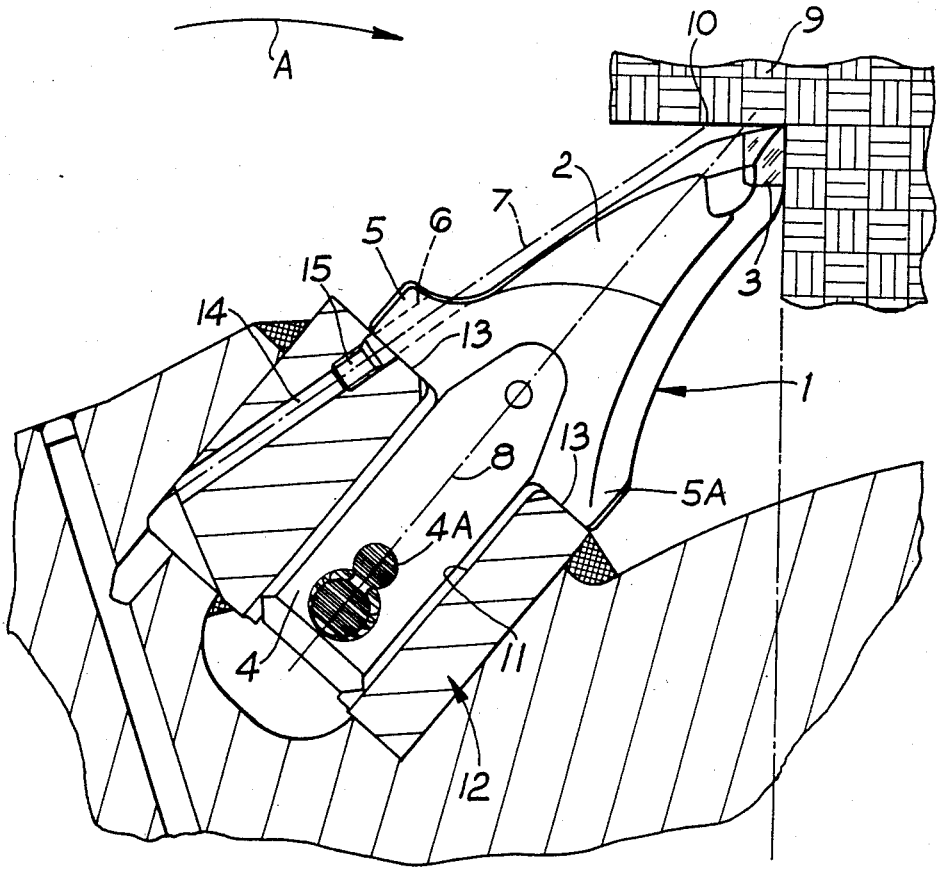

This invention relates to a mineral cutter pick, to a pick and box combination, and to an adaptor.

In the winning of minerals such as coal, a plurality of mineral cutter picks are releasably retained in pick boxes provided around the periphery of a rotatable cutting head or drum. Conventionally, each pick comprises a head, from which extends an integral shank, of circular or rectangular cross-section, to be releasably retained, by any one of several kinds of latching arrangements, within an aperture of corresponding cross-section provided in the pick box, the head usually terminating, remote from the shank, in a hard metal tip e.g. of tungsten carbide. Instead of locating the pick shank directly into the box aperture, it is also known to employ an adaptor for various purposes, with the pick shanks fitted into the adaptor and the adaptor fitted into the box aperture.

In order to achieve a dust suppressing effect, it is known to effect a water spray in the vicinity of the tip, and usually in advance of the tip, although proposals have been made to provide a water spray rearwardly of the tip, to reduce the effect of what is known as incendive sparking. Furthermore, if water is conveyed through the pick for this spraying effect, there is additionally a pick cooling effect.

Thus, to provide water, either as a spray or jet, forwardly and/or rearwardly of the tip, known pick constructions have incorporated at least one water conveying bore terminating at one end in a spray or jet nozzle and connectable at their other end to a water supply source, associated with the pick box, and spigot and socket type pick-to-box connector arrangements have been proposed for the water supply. However, pick manufacture is relatively expensive involving not only the drilling of a bore, in most cases along virtually the entire length of the pick, but also its subsequent tapping, if the spray nozzle is of a screw-in type, or other machining if of a non-screw in type, as it is desirable to be able to remove the nozzle for cleaning or replacement purposes. Furthermore, it will be appreciated that the drilling of a bore(s) diminishes the mechanical strength of the pick. As an alternative, or addition, to the mounting of nozzle(s) on a pick, it is also known to mount nozzle(s) on a box, but whilst such a location is more remote from the zone where the water spray is most effective, it does have the advantage, particularly when considering the trailing drum of a double-ended ranging-drum shearer type mining machine, that the box-mounted nozzles of whichever is the trailing drum (dependent on the direction of traverse of the machine) are not immersed in coal slurry etc., as are the pick heads and consequently the head mounted nozzles, and hence are not as prone to blockage as are pick-mounted nozzles, thereby exhibiting a longer operational cycle before nozzle removal and cleaning or replacement might be required. In detail, a water conveying bore must be drilled in the box and again be tapped if a screw-in type nozzle is involved. However, box mounted nozzles are self-aligning in that the direction of the water spray or jet is guaranteed to be in the vicinity of the tip, which is not the case with another arrangement whereby nozzles are mounted on vanes (usually by welding nozzle housings to the vanes) conventionally provided around a rotary cutting head, the pick boxes being welded, at spaced-apart locations around the vane(s), but again the vane must be drilled to provide a water conveying bore and the bore tapped, to receive a screw-in type nozzle, but with this arrangement the correct directional alignment of both the nozzle and the box cannot be guaranteed.

However, irrespective of the location of the nozzles on the pick and/or boxes and/or vanes, they are prone to debris blockage and/or damage. It follows that a blocked or damages nozzle is ineffective in any dust suppression, pick cooling etc., action and removal for cleaning or replacement of a nozzle is a tedious operation in a mining environment. Furthermore, with regard to known connector arrangements for water supply, difficulties are not unknown in accurately aligning the components of the connector arrangements particularly when new picks are inserted into worn boxes, and also avoiding damage to the connector arrangements during transit to, and fitting on, a rotary cutting head or drum in the prevailing mine conditions.

According to a first aspect of the present invention, there is provided a mineral cutter pick comprising a head terminating at one end thereof in a hard material tip, an integral shank extending from the head in a direction away from the tip, at least one laterally extending shoulder provided on the head, and a bore extending through the shoulder, generally in the longitudinal direction of the pick, through which bore a water spray or jet may be passed.

According to a second aspect of the present invention, there is provided, in combination, a mineral cutter pick as defined in accordance with the first aspect, and a pick box comprising an aperture extending inwardly from a seating surface engaged by the shoulder(s) of the pick and of cross-section corresponding to that of the shank of the pick inserted into the box aperture, and a water supply bore connectable at one end to a source of pressurised water and terminating at its other end in a water spray or jet nozzle located beneath the or a pick shoulder, such that a water spray or jet emitted by the nozzle passes through the shoulder bore and is directed to the vicinity of the pick tip.

It will be appreciated that firstly the supply of water to the pick is no longer effected through the pick proper, thus eliminating manufacturing costs such as the need to drill a bore hole along substantially the entire length of the pick and a resulting weakening of the pick, while the location of the nozzle beneath the shoulder results in the nozzle being protected by the shoulder against damage and to a large extent blockage, but should blockage occur, this would normally be of the shoulder bore and not the nozzle, and such shoulder blockage is readily cured by removing the pick and pushing a tool e.g., a screwdriver blade, through the bore to clear the debris, but removal of the nozzle from the vicinity of the tip in any event reduces the propensity of nozzle blockage.

The shoulder preferably extends rearwardly of the pick (having regard to the direction of rotation of the head on which the associated pick box is mounted) and hence firstly an enhanced dust suppression effect is achieved as the water is sprayed towards the cut material behind the pick and not across such material, as occurs with conventional dust suppression tools, while secondly, the water is sprayed onto both the groove cut by the pick and onto the pick head to reduce if not eliminate incendive sparking. However, the pick may be provided with two shoulders one extending forwardly and the other extending rearwardly of the pick, and both may have a through bore, for association with a box having two nozzles, if it is desired to emit a water spray or jet both forwardly and rearwardly of the pick.

The pick may be of the forward or radial attack type, in which case the tip is required to have a predetermined orientation, usually achieved by giving the shank a rectangular section, to fit a box aperture of corresponding section; or with a cylindrical, or frusto conical shank, usually with some pick rotation restraining means, if this is not achieved between the shank and box aperture. With most if not all of the above arrangements, the shank fits directly into the box aperture, but if required, an adaptor may be interposed between the shank and the box aperture.

Figure 2:
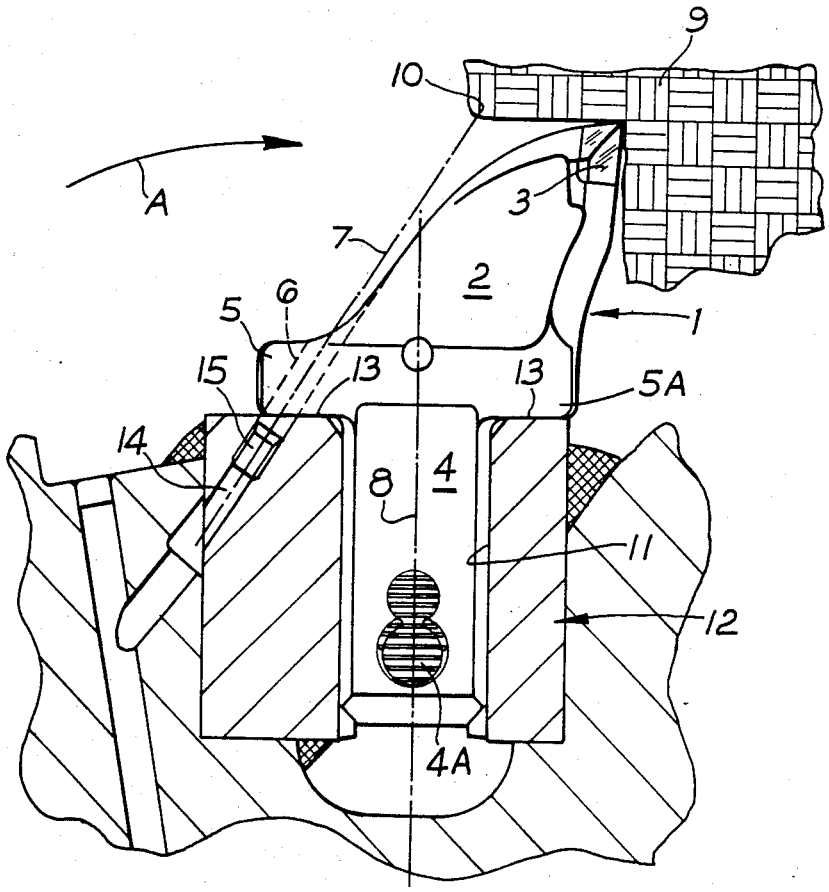
Figure 3:
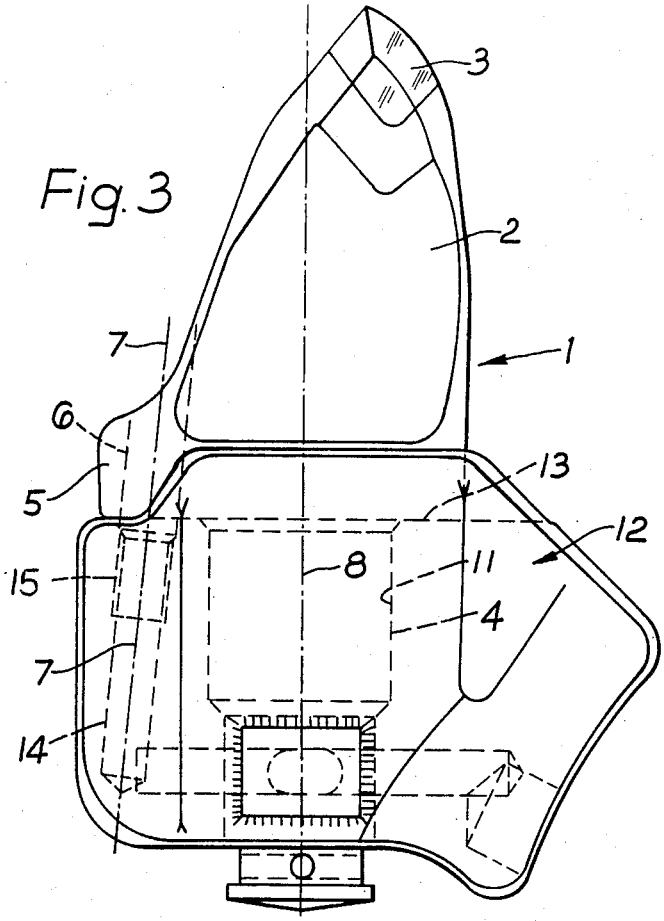
Figure 4:
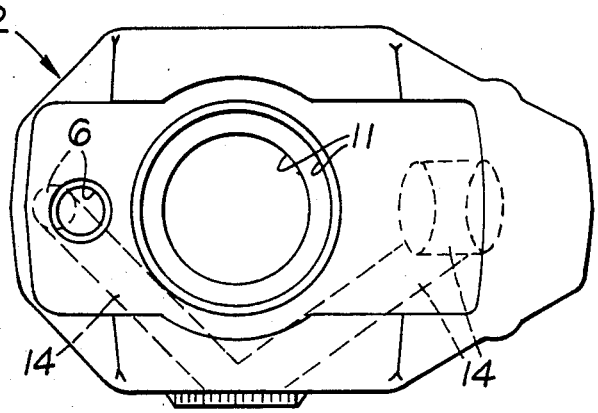
Figure 5:
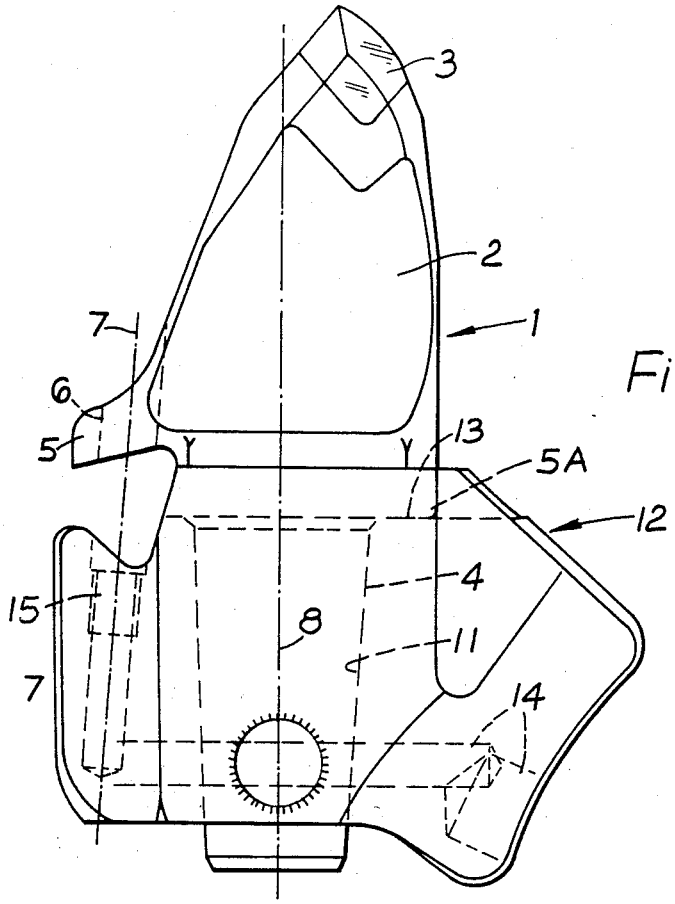

The invention will now be described in greater detail, by way of example, with reference to the accompanying drawings, in which:

FIG. 1 is a part sectional side elevation of a forward attack pick in accordance with the first aspect of the invention, and a pick and box combination in accordance with the second aspect of the invention;

FIG. 2 corresponds to FIG. 1 but shows a radial type pick and a slightly modified pick box;

FIG. 3 corresponds to FIG. 1 but shows another form of pick and pick box;

FIG. 4 is a plan view of the pick box of FIG. 3;

FIG. 5 corresponds to FIG. 1 but shows another form of pick and pick box; and

Figure 6:
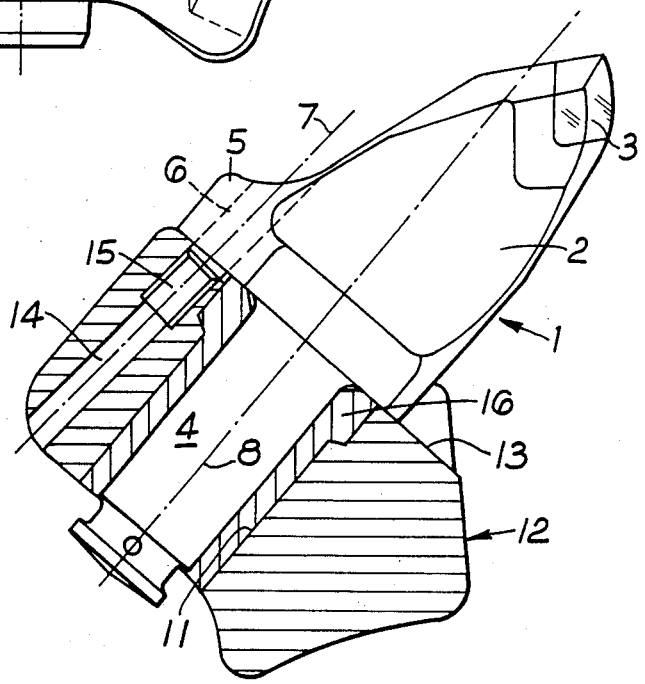

FIG. 6 also corresponds to FIG. 1 but shows yet another form of pick and pick box.

In all embodiments, like components are accorded like reference numerals.

In the drawings, a mineral cutter pick 1 comprises a head 2 terminating at one end thereof in a hard material tip 3, with an integral shank 4 extending from the head 2 in a direction away from the tip 3. In FIGS. 1 and 2 the shank is rectangular, in FIGS. 3 and 6 the shank is circular, and in FIG. 5 the shank is frusto-conical. A shoulder 5 located and extending rearwardly (having regard to direction of movement, in use, of the pick 1 which is indicated by the arrow A) is provided on the head 2 in the vicinity of the transition between the head and the shank, and a bore 6 extends through the shoulder 5. The head 2 is also provided with a second shoulder 5A extending forwardly. The bore 6 has a longitudinal axis 7 which in the embodiment of FIG. 1 extends generally in the longitudinal direction of the pick, as illustrated by the axis 8 of the shank 4, although tapering towards the axis 8 so that, in use, with the pick 1 mounted on a rotary cutting head, the pick removes mineral to leave a mineral seam 9, with the axis 7 intersecting the seam 9 at a point 10.

In the embodiment of FIG. 2, the axis 7 tapers at a more pronounced angle to the axis 8.

In accordance with the second embodiment the pick 1 is releasably locatable by a known latching device 4A carried by its shank 4 in a correspondingly section aperture 11 in a pick box 12 having a seating surface 13 engaged by the shoulder(s) 5. The box 12 is also provided with a water supply bore 14 connectable at one end to a source of pressurized water and terminating at its other end in a water spray or jet nozzle 15 located beneath the shoulder 5 such that water emitted by the nozzle 15 passes through the bore 6 and along, or generally along the axis 7 to the area behind the tip 3, generally in the vicinity of the point 10, to reduce, if not eliminate any incendive sparking tendencies which occur not infrequently when the pick 1 inadvertently leaves a coal etc., seam and strikes a harder mineral, e.g. sand stone, and also to have a dust suppressing effect, and, if used in a high pressure mode, possibly to give a stress relieving slot ahead of and/or behind the pick.

In the embodiments of FIG. 3 and 4 the shank 4 is circular and stepped, to fit a correspondingly circular and stepped aperture 11 in the pick box 12.

In the embodiment of FIG. 5, the pick 1 is again of the forward attack type but shank 4 is frusto-conically tapered.

In the embodiment of FIG. 6, the pick 1 has a circular section shank 4 and, in contrast to the previous embodiments, does not fit directly into the pick box aperture but fits into an adaptor 16.

With any embodiment, if the pick is provided with a forward shoulder 5A this likewise could be provided with a through bore, and the receiving pick box with a second water emitting nozzle aligned with this second through bore, to provide a water spray or jet in advance of the cutting tip.

What I claim is:

1. A mineral cutter pick for use on a rotary, mineral cutting drum; said pick comprising a pick head, a hard material tip located at one end of said head, an integral, elongate shank extending from an opposite end of said head in a direction away from said tip and having a longitudinal axis, said tip being located forwardly of said longitudinal axis (having regard to the direction or rotation, in use, of said rotary cutting drum), a shoulder provided on said pick head and extending rearwardly of said longitudinal axis (having regard to the direction of rotation, in use, of said rotary cutting drum), said shoulder having, remote from said tip, an inner face (extending laterally with respect to said longitudinal axis) and an outer face longitudinally spaced from said inner face, with a shoulder aperture extending from said inner face to said outer face and generally in the direction of said longitudinal axis, and emerging at said outer face, whereby a water spray or jet may, in use, be directed to and through said aperture to a zone rearwardly of said tip, having regard to the direction of rotation, in use, of said rotary cutting head.

2. A pick as claimed in claim 1, provided with two shoulders, one extending forwardly and the other extending rearwardly of the pick (having regard to the direction of rotation, in use, of a rotary cutting head).

3. A pick as claimed in claim 1, of the forward attack type.

4. A pick as claimed in claim 1, of the radial attack type.

5. A pick as claimed in claim 1, having a rectangular section shank.

6. A pick as claimed in claim 1, having a cylindrical section shank.

7. A pick as claimed in claim 1, having a frusto-conical section shank.

8. A mineral cutter pick as defined in claim 1, in combination with a pick box, said pick box comprising a seating surface engaged by said shoulder of said pick with an aperture extending inwardly from said seating surface, which aperture is of cross-section corresponding to that of said shank of said pick, which shank is inserted into said box aperture, and a water supply bore provided in said pick box and, said bore having one end thereof connectable to a source of pressurised water and a water spray/jet nozzle provided at the other end of said bore and located beneath said shoulder, such that a water spray/jet emitted by said nozzle passes through said bore and is directed to the vicinity of said pick tip.

9. A pick and box combination as claimed in claim 8, provided with an adaptor interposed between said shank and said box aperture.

* * * * *